United States Patent [19]

Weder et al.

[11] Patent Number: 4,733,521

[45] Date of Patent: Mar. 29, 1988

[54] COVER FORMING APPARATUS

[75] Inventors: Donald E. Weder; Erwin H. Weder; Herbert A. Weder, all of Highland, Ill.; Franklin J. Craig, Valley Park, Mo.

[73] Assignee: Highland Supply Corporation, Highland, Ill.

[21] Appl. No.: 865,206

[22] Filed: May 20, 1986

[51] Int. Cl.[4] ..... B65B 11/00; A01G 9/02

[52] U.S. Cl. ..... 53/580; 47/72; 53/221; 53/390; 206/423

[58] Field of Search ..... 53/209, 220, 221, 222, 53/223, 390, 464, 580, 528, 578; 206/423; 47/66, 72, 84; 72/481

[56] References Cited

U.S. PATENT DOCUMENTS

| | | | |
|---|---|---|---|
| 557,526 | 3/1896 | Egge | 229/8 |
| 1,868,853 | 7/1932 | Sievers | 229/8 |
| 2,118,551 | 5/1938 | Doble | 53/464 |
| 2,204,664 | 6/1940 | Clark | 229/8 |
| 2,218,293 | 10/1940 | Muller | 53/221 |
| 2,265,636 | 12/1941 | Eaton | 53/222 |
| 2,355,559 | 8/1944 | Renner | 229/8 |
| 2,482,981 | 9/1949 | Kamrass | 41/13 |
| 2,622,380 | 12/1952 | Snyder | 53/15 |
| 2,656,659 | 10/1953 | Buechek | 53/221 |
| 2,780,401 | 2/1957 | Stevens | 229/2.5 |
| 2,971,312 | 2/1961 | Bell | 53/390 |
| 3,189,502 | 6/1965 | Little | 156/210 |
| 3,245,198 | 4/1966 | Schmied | 53/221 |
| 3,318,748 | 5/1967 | Hurst | 156/224 |
| 3,466,214 | 9/1969 | Polk et al. | 161/43 |
| 3,488,022 | 1/1970 | Vittori | 248/27.8 |
| 3,542,616 | 11/1970 | Cain et al. | |
| 3,775,932 | 12/1973 | Jeney | 53/22 |
| 3,791,902 | 2/1974 | Hanke et al. | 156/212 |
| 3,962,503 | 6/1976 | Crawford | 428/40 |
| 4,043,077 | 8/1977 | Stonehocker | 47/66 |
| 4,170,618 | 10/1979 | Adams | 264/101 |
| 4,300,312 | 11/1981 | Weder et al. | 47/72 |

FOREIGN PATENT DOCUMENTS

| | | | |
|---|---|---|---|
| 76772 | 11/1953 | Denmark | 53/221 |
| 391084 | 4/1933 | United Kingdom | 53/220 |

OTHER PUBLICATIONS

Exhibit A—Photograph of a Two-Part Pot Covering System Manufactured by Floral Decor, a Subsidiary of John Henry Co. of Lansing, Michigan.

*Primary Examiner*—Robert L. Spruill
*Assistant Examiner*—Donald R. Studebaker
*Attorney, Agent, or Firm*—Dunlap, Codding & Peterson

[57] ABSTRACT

A cover forming apparatus for forming a sheet of material about an object to produce a decorative cover for the object. The cover forming apparatus includes a cover former having an object opening formed through a portion thereof which is adapted to receive the object. The cover former includes portions forming resilient contactors which are adapted to resiliently engage portions of the sheet of material for pressing the engaged portions of the sheet of material against the object when the sheet of material and the object are passed through the object opening. The cover forming apparatus particularly is useful for forming the sheet of material about flower pots to form a decorative flower pot cover.

16 Claims, 11 Drawing Figures

COVER FORMING APPARATUS

FIELD OF THE INVENTION

The present invention generally relates to cover forming apparatus for forming a sheet of material about an object to produce a cover for the object and, more particularly, but not by way of limitation, to a cover forming apparatus for producing a decorative cover for a flower pot type of object.

SUMMARY OF THE INVENTION

The present invention comprises a cover forming apparatus for forming a sheet of material about an object to produce a cover for the object. The apparatus comprises a cover former having an object opening formed through a portion thereof adapted to receive a portion of the object. The cover former has portions forming resilient contactors, which cooperate to form the object opening. The contactors are resiliently engagable with portions of the sheet of material and adapted for pressing the engaged portions of the sheet of material against the object when the object with the sheet of material disposed near the object are passed through the object opening with the sheet of material being disposed generally about the outer peripheral surface of the object as the sheet of material and the object are passed through the object opening, the sheet of material being formed by the cover former into the cover for the object.

BRIEF DESCRIPTION OF THE PREFERRED EMBODIMENT

In the florist and nursery industries, it is common to cover flower pots containing potted plants with sheets of material made of foil, paper, plastic films, and the like. Flower pot covers not only decorate the potted plant, but also serve several useful purposes. For example, covers made of waterproof materials such as plastics and foil prevent leakage from the bottom of the pot. Also, light reflective materials insulate the soil within the pot against temperature increases from overexposure to sunlight. Pot covers also serve to protect the soil and, to some extent, the foliage, from cold air drafts and sudden temperature changes. Further, pot covers may serve as padding during shipment (especially useful with fragile clay pots) and as a means for carrying the pots.

The cover forming apparatus of the present invention is useful at all levels of the florist and nursery industry. The apparatus may be used by retail florists to apply the cover at the time of sale to the ultimate consumer. By maintaining an inventory of several types of cover materials, the retail florist can select the choice of cover material, according to each customer's individual choice.

The wholesalers and growers also will find the present invention useful for wrapping potted plants during storage and shipment to supermarkets, variety stores and other retail outlets. With regard to use of the present invention by wholesalers and growers, it should be noted that the apparatus of the present invention easily may be adapted for use for mass production with other devices in a packaging line, such as conveyors, turntables, holding and feeding jigs and cartoning equipment.

Figure 1:
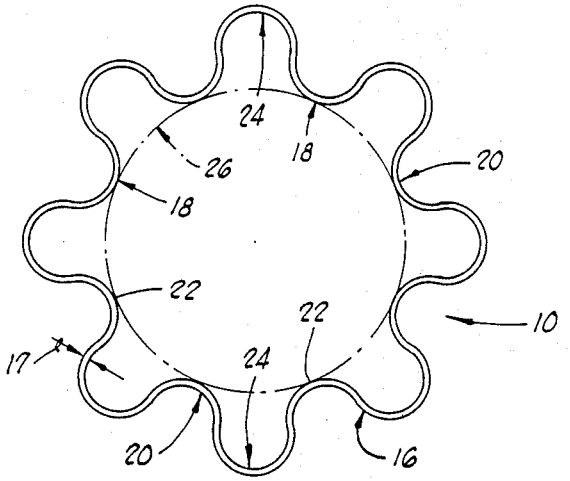
FIG. 1 is a plan view of a cover former which is constructed in accordance with the present invention.
Figure 2:
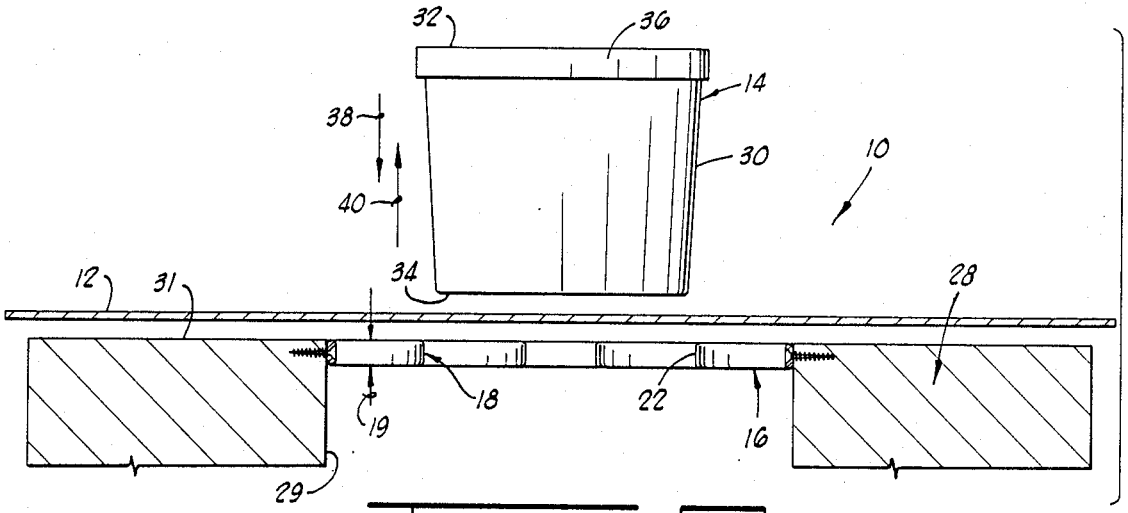
FIG. 2 is a side elevational, partial sectional view of a cover forming apparatus which includes the cover former of FIG. 1 connected to a cover forming support assembly and showing a sheet of material and a flower pot (object) in a position for forming the sheet of material about the flower pot (object) to produce a decorative flower pot cover.
Figure 3:
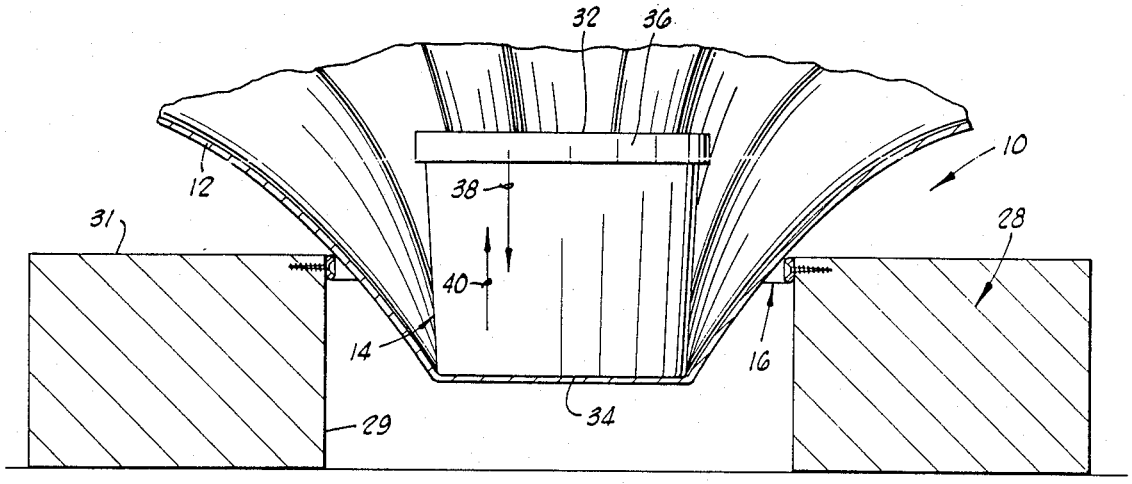
FIG. 3 is a view similar to FIG. 2, but showing the flower pot (object) and the sheet of material disposed in a portion of the cover forming apparatus during the use of the cover forming apparatus.
Figure 4:
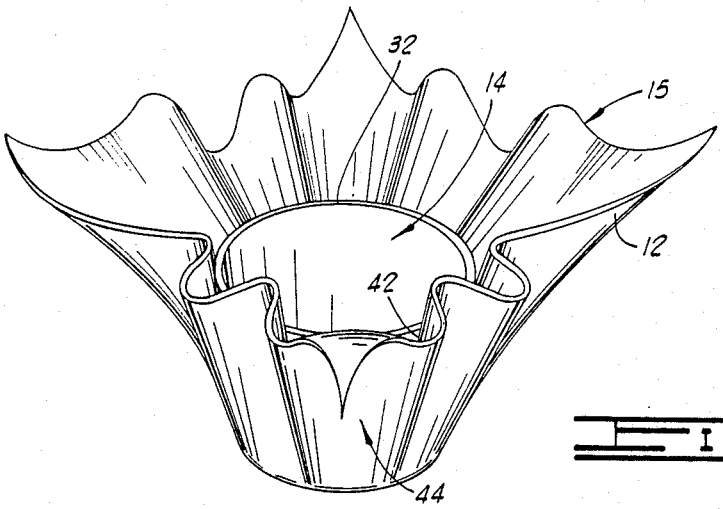
FIG. 4 is a partial perspective view of a flower pot (object) with a decorative cover disposed thereabout formed utilizing the cover forming apparatus shown in FIGS. 1 2, and 3.

Shown in FIGS. 1, 2 and 3 is a cover forming apparatus 10 which is constructed in accordance with the present invention. The cover forming apparatus 10 is constructed and adapted to form a sheet of material 12 about an object 14 to produce a cover 15 (shown in FIG. 4) for the object 14. A sheet of material 12 and the object 14 in the form of a flower pot are shown in FIGS. 2, 3, and 4 and a decorative cover 15 produced utilizing the cover forming apparatus 10 is shown in FIG. 4 operatively associated with the flower pot (object) 14.

In one preferred embodiment, the cover forming apparatus 10 provides a relatively non-complex structure which may be utilized to form the decorative cover 15 in a relatively simple, economical and efficient manner. When utilized in this manner, a plurality of sheets of material 12, or a roll of material from which sheets can be cut, may be stored at the point of use and the decorative cover 15 may be formed one at a time upon request. This eliminates the need to store large numbers of pre-formed decorative covers 15 which are more difficult to store and occupy more space than do sheets or rolls of material. This provides an economic advantage as well, as pre-formed decorative covers are more expensive due to labor costs.

The sheet of material 12 contemplated by the present invention is constructed, or is of a construction, such that the sheet of material 12 is formable about the object 14 to produce the decorative cover 15 for the object 14. Materials suitable for use with the apparatus of the present invention include foils, such as aluminum foil, plastic films, cellophanes, papers (waxed and unwaxed) and laminations of combinations of these.

In one embodiment, portions of the sheet of material 12 are brought into contacting engagement with the object 14 by the cover forming apparatus 10 and the sheet of material 12 is of a construction such that the portions of the sheet of material 12 so brought into contact with the object 14 are adhered to the object 14, thereby forming a decorative cover 15 having portions thereof adhesively connected to the object 14.

In one other embodiment, the sheet of material 12 is formable into shapes and the sheet of material 12 substantially is settable (has sufficient strength to stand upright on its own) so the sheet of material 12 substantially retains the shape so formed and, in this embodiment, portions of the sheet of material 12 may or may not be adhesively connected to portions of the object 14 depending on the desires of a particular user, the cover forming apparatus 10 functioning to set the sheet of material 12 in a predetermined form about the object 14. It should be noted that the formable and settable materials contemplated by the present invention are described as being substantially settable since such materials can be deformed from the formed shape or, in other words, such materials are not permanently set in a particular form.

The sheet of material 12 of the type contemplated by the present invention, where portions of the sheet of material 12 are adhesively connected to the object 14 when the sheet of material 12 is formed into the decorative cover 15, preferably is selected from the group of materials consisting of plastic films, foils, papers, cellophanes and combinations thereof. In this instance, one side of the sheet of material 12 is coated with a pressure sensitive adhesive of a type adapted to adhesively connect portions of the sheet of material 12 to the object 14 when such portions of the sheet of material 12 are brought into contact with the object 14 under sufficient pressure to effect the adhesive connection at room temperatures.

In an alternate embodiment, the adhesive may be of the type adapted to effect the adhesive connection when brought into contact with the object 14 at elevated temperatures, the cover forming apparatus 10 including means for applying heat (not shown) and pressure to the portions of the sheet of material 12 to be adhesively connected to the object in this last-mentioned instance. In other embodiments, the adhesive may be applied to the object 14 or to the sheet of material 12 and the object 14. In still other embodiments, the adhesive is applied only to portions of the sheet of material 12 or the object 14.

It should be noted that various types of adhesives may be used. Suitable adhesives include those that adhere only to similarly coated surfaces or to surfaces coated with a substance receptive to acceptance of the bond. In one embodiment, the sheet of material 12 is coated with a self-sticking adhesive. In this instance, the sheet of material 12 is formed into a shape-sustaining decorative cover 15 by the adherence of the inner surfaces of the folds created during use of the cover forming apparatus. A cover formed in this manner easily could be removed from the flower pot (object) 14 without losing its shape. Although contact adhesives are particularly desirable, other types of adhesives also may be used. For example, adhesive may be applied, such as by spraying, brushing and the like, to the sheet of material 12, or to the object 14, or to both, immediately prior to use of the apparatus 10.

The sheet of material 12 of the type contemplated by the present invention, which is formable in predetermined shapes and which is substantially settable so the formed sheet of material 12 substantially retains the shape so formed to form the decorative cover 15, preferably is a material selected from the group of materials consisting of aluminum foil, waxed paper, foil, plastic film, and combinations thereof. As mentioned before, in one embodiment, this formable sheet of material 12 includes a coating of a pressure sensitive adhesive applied to one side of the sheet of material 12 and, in this instance, the portions of the sheet of material 12 which are brought into contact with the object 14 by the cover forming apparatus 10 are adhesively connected to the object 14. As mentioned before, the adhesive may be of the type adapted to effect the adhesive connection at room temperatures or at elevated temperatures whichever may be desirable in a particular application.

Various types or constructions of sheets of material 12 are suitable for forming decorative covers 15 of the type contemplated by the present invention are well known in the art and various adhesives suitable for use with such sheets of material 12 in the manner described before also are well known in the art.

The cover forming apparatus 10 includes a cover former 16 which, in one preferred embodiment as shown in FIGS. 1, 2 and 3, is constructed of a strip of material connected end-to-end to form a continuous strip of material having a generally circular shape. The strip of material is relatively thin having a thickness 17 (shown in FIG. 1) and the strip of material has a relatively small width 19 (shown in FIG. 2).

The cover former 16 or strip of material has a plurality of circumferentially spaced apart contactors 18 formed thereon (only two of the contactors 18 being designated in the drawings by reference numeral). The contactors 18 are positioned, shaped and adapted to contact the sheet of material 12 and to bring the contacted portions of the sheet of material 12 into engagement with the object 14, each contactor 18 applying a pressure to press the contacted portions of the sheet of material 12 into pressing engagement with with object 14 during the forming of the decorative cover 15.

As shown more clearly in FIG. 1, the cover former 16 more particularly includes a plurality of circumferentially spaced apart arc-shaped portions 20 with each arc-shaped portion 20 having an outermost end 22 (only two of the arc-shaped portions 20 and only two of the outermost ends 22 being designated by reference numerals in the drawings). The portions of each arc-shaped portion 20 generally near the outermost end 22 cooperate to form the contactors 18, the contactors 18 being the portions of the arc-shaped portions 20 which contactingly engage and press portions of the sheet of material 12 against the object 14 during the forming of the decorative cover 15.

A plurality of circumferentially spaced apart recessed areas 24 are formed in the cover former 16 (only two of the recessed areas 24 are designated by reference numerals in the drawings). Each recessed area 24 is disposed generally between two adjacent arc-shaped portions 20 or contactors 18 and each recessed area 24 is shaped and adapted to accommodate a portion of the sheet of material 12 during the forming of the decorative cover 15, the portions of the sheet of material 12 disposed in the recessed areas 24 being spaced a distance away from the object 14 during the forming of the decorative cover 15 for reasons to be made more apparent below.

The outermost ends 22 of the arc-shaped portions 20 cooperate to define a generally circularly shaped object opening 26 (shown in FIG. 1) formed through a central portion of the cover former 16. The object opening 26 is shaped and adapted to receive the sheet of material 12 operatively associated with the object 14 during the forming of the decorative cover 15, the object opening 26 being shown in dashed-lines in FIG. 1 for the purpose of illustrating the object opening 26 and the positioning of the outer end 22 portions. The outermost end 22 portions are positioned and adapted to engage the sheet of material 12 and press the sheet of material 12 into contact and against the object 14 as the object 14 and the sheet of material 12 are passed through the object opening 26 during the forming of the decorative cover 15.

The strip of material forming the cover former 16 is constructed of a resilient material with relatively high elasticity and, particularly, the contactors 18 of the cover former 16 are resilient, the contactors 18 per se each cooperating to impart a resilient contacting action. Thus, the contactors 18 are constructed and adapted so the outermost end 22 portions or, more particularly, the contactors 18 resiliently contact the sheet of material 12 and press the sheet of material 12 against the object 14 during the forming of the decorative cover 15, the contactors 18 having the ability to be deformed to some extent as the object 14 is passed through the object opening 26 for accommodating an object 14 having a varying diameter and for resiliently applying a force to forcibly bring the sheet of material 12 into contact with the object 14 and yet resiliently return substantially to the same shape after the object 14 has been removed from the object opening 26.

It should be noted that the cover former 16 could be constructed of a plurality of circumferentially spaced apart arc-shaped portions 20 connected to a cover forming support assembly 28 (shown in FIGS. 2 and 3), if desired in a particular application. In this embodiment, the cover former 16 is not constructed of a continuous strip of material; however, each of the recessed areas 24 still are disposed between adjacent pairs of contactors 18.

The cover forming apparatus 10 includes the cover forming support assembly 28 (shown in FIGS. 1 and 2). The cover forming support assembly 28 may be constructed of two spaced apart elements forming an opening 29 therebetween or the cover forming support assembly 28 may be formed of a single, unitary element with the opening 29 formed through a portion thereof.

The cover former 16 is disposed in the opening 29 in the cover forming support assembly 28 with the object opening 26 in the cover former 16 being aligned with the opening 29 in the cover forming support assembly 28, the opening 29 being shaped and adapted to accommodate the sheet of material 12 operatively associated with the object 14 during the forming of the decorative cover 15. The cover forming support assembly 28 includes a support surface 31 and the cover former 16 is disposed generally adjacent the support surface 31. The cover forming support assembly 28 supports the cover former 16 in a position wherein the object opening 26 is disposed in a substantially horizontal plane.

As shown in FIGS. 2 and 3, the object 14 more particularly is a flower pot having an outer peripheral surface 30, an upper end 32 and a lower end 34, a rim 36 portion being formed at the upper end 32 portion. The diameter of the flower pot object 14 is larger at the upper end 32 portion generally below the rim 36, as compared to the smaller diameter of the flower pot object 14 generally at the lower end 34, thereby forming a generally frusto-conically shaped object 14. The central portion of the flower pot object 14 is opened for accommodating soil and a portion of a plant in a well known manner.

In one preferred form the sheet of material 12 generally has a square shape. However, it is to be understood that various shapes of sheets of material may be employed. For example, attractive covers may be formed using round and scalloped shaped sheets. Further, the shape of the outer borders of the sheet of material 12 may be altered before or after the cover is formed.

The sheet of material 12 initially is disposed generally over the object opening 26 with the object opening 26 being positioned generally under a central portion of the sheet of material 12, the sheet of material 12 being supported in this position generally on the support surface 31 of the cover forming support assembly 28 with the cover former 16 also cooperating to support the sheet of material 12. With the sheet of material 12 in this position (shown in FIG. 2), the flower pot object 14 is positioned generally above the sheet of material 12 and generally over the object opening 26 in the cover former 16, the lower end 34 of the flower pot object 15 being disposed generally near and above the sheet of material 12.

The flower pot object 14 manually is moved in a downward direction 38 to a position wherein the lower end 34 of the flower pot object 14 engages the sheet of material 12 and then the flower pot object 14 further is moved in the downward direction 38 through the object opening 26, the flower pot object 14 pushing the sheet of material 12 through the object opening 26 as the flower pot object 14 is moved in the downward direction 38 through the object opening 26 (the flower pot object 14 with the sheet of material 12 being shown in FIG. 3 particularly disposed through the object opening 26 in the cover former 16). As the sheet of material 12 and the flower pot object 14 are moved in the downward direction 38 through the object opening 26, the outermost ends 22 of the arc-shaped portions 20 (the contactors 18) contact the sheet of material 12 and press the sheet of material 12 against the outer peripheral surface 30 while simultaneously portions of the sheet of material 12 are disposed within and passed through the recessed areas 24, the portions of the sheet of material 12 disposed within the recessed areas 24 being spaced a distance from the outer peripheral surface 30 of the flower pot object 12 so that these portions of the sheet of material 12 are not brought into contacting engagement with the outer peripheral surface 30 of the flower pot object 12 as the sheet of material 12 and the flower pot object 14 are passed in the downward direction 38 through the object opening 26 during the forming of the decorative cover 15. The sheet of material 12 along with the flower pot object 14 are passed in the downward direction 38 through the object opening 26 in the cover former 16 until the rim 36, or the upper end 32 of the object is at about the same level as the upper end of the cover former 16. In objects having rims, the rim 36 may serve to limit the movement of the flower pot object 14 in the downward direction 38 through the object opening 26. In those instances where the flower pot object 14 either does not include a rim 36, or where the rim does not limit the downward movement of the flower pot object 14, the object 14 is moved in the downward direction 38 until the upper end 32 of the flower pot object 14 is disposed generally near the cover former 16.

Next, the flower pot object 14 with the formed sheet of material 12 is removed from the cover former 16. The flower pot object 14 with the formed sheet of material 12 may be removed manually by withdrawing the covered object by moving it in an upward direction 40 back out through the upper end of the object opening 26 in the cover former 16. Alternatively, the covered object may be pushed completely through the object opening 26 and removed from the bottom of the cover former 16.

With respect to the sheet of material 12 which is adapted to be adhesively connected to the flower pot object 14, the contactors 18 press portions of the sheet of material 12 into contact with the flower pot object 14 as the flower pot object 14 and the sheet of material 12 are passed through the object opening 26, thereby causing those portions of the sheet of material 12 to be adhesively connected to the outer peripheral surface 30 of the flower pot object 14, while the portions of the sheet of material 12 which are disposed in the recessed areas 24 as the sheet of material 12 and the flower pot object 14 are spaced a distance from the outer peripheral surface 30 of the flower pot object 14 and thus not adhesively connected to the outer peripheral surface 30 of the flower pot object 14. As shown in FIG. 4, the decorative cover 15, which is formed in this manner, includes portions 42 of the sheet of material 12 which are adhesively connected to the flower pot object 14 and such adhered portions 42 extend axially up the outer peripheral surface 30 and generally between the upper and the lower ends 32 and 34, the adhesive connection terminating immediately below the rim 36 of the flower pot object 14. The portions of the sheet of material 12 which were disposed within the recessed areas 24 as the sheet of material 12 and the flower pot object 14 were passed through the object opening 26 in the cover former 16, extend outwardly from the outer peripheral surface 30 of the flower pot object 14 and extend in an axial direction generally between the upper and the lower ends of the flower pot object 14 forming decorative arcs of material 44, such arcs of material 44 extending upwardly and outwardly from the upper end 32 of the flower pot object 14. The adhered portions 42 and the arcs of material 44 each are shaped circumferentially about the outer peripheral surface 30 of the flower pot object 14 with an adhered portion 42 being disposed generally between adjacent pairs of arcs of material 44. In the embodiment of the decorative cover 15 shown in FIG. 4, the sheet of material 12 is sized large enough so the decorative cover 15 includes portions extending generally upwardly and outwardly from the upper end 32 of the flower pot object 14 and circumferentially about the flower pot object 15, such portions presenting a somewhat irregular pattern since the original shape of the sheet of material 12 is square.

With respect to the sheet of material 12 which is adapted to be formed and substantially settable in the formed shape, the decorative cover 15 formed utilizing the cover forming apparatus 10 also will appear in the form shown in FIG. 4, except the adhered portions 42 are not adhesively connected to the outer peripheral surface 30 of the flower pot object 14, such portions 42 being merely disposed generally adjacent the outer peripheral surface 30 of the flower pot object 14 when the decorative cover 15 is disposed about the flower pot object 14. Even with respect to the sheet of material 12 which is formable and substantially settable, the portions 42 will be adhesively connected to the outer peripheral surface 30 of the flower pot object 14 when one side of such sheet of material 12 is coated with a contact adhesive in the manner described before, which may be desirable in some applications.

As the flower pot object 14 with the sheet of material 12 are passed downwardly through the object opening 26 in the cover former 16, the outer peripheral surface 30 of the flower pot object 14 presses against the outermost ends 22 of the arc-shaped portions 20, thereby tending to deform or flatten such arc-shaped portions 20, although not actually flattening such arc-shaped portions 20. As the larger diameter portions of the flower pot object 14 pass through the object opening 26 in the cover former 16 such flattening of the arc-shaped portions increases, thereby tending to further deform such arc-shaped portions. As mentioned before, the contactors 18 (the portions of the arc-shaped portions 20 which contactingly engage the sheet of material 12 and the flower pot object 14) are resilient, so the arc-shaped portions 20 return to their original shape when the flower pot object 14 is removed from the object opening 26 in the cover former.

It should be noted that the ed9es of the contactors 18 preferably are smooth so that the contactors 18 will not tear the sheet of material 12 as the sheet of material 12 alon9 with the object 14 are passed through the object opening 26 in the cover former 16. In one form, the strip of material comprising the cover former 16, may be coated with a material for decreasing the resistance between the contactors 18 and the sheet of material 12 to prevent the tearing of the sheet of material 12 during the forming of the decorative cover 15.

Figure 5:
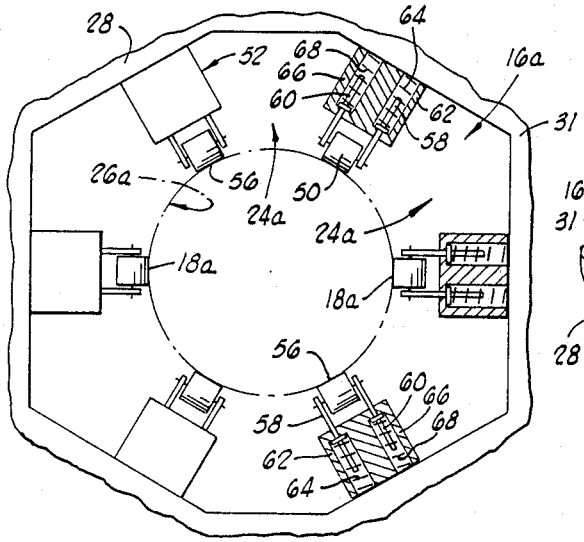
FIG. 5 is a plan view of a modified cover forming apparatus.
Figure 6:
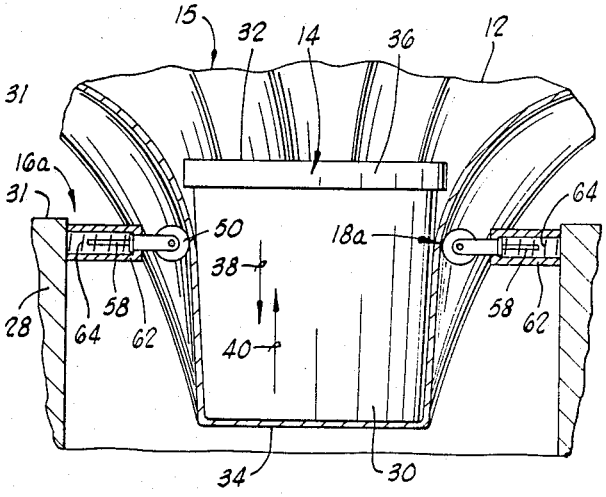
FIG. 6 is a side elevational, partial sectional view showing the modified cover forming apparatus of FIG. 5 in a position for forming a sheet of material about a flower pot (object).

Embodiment of FIGS. 5 and 6

Shown in FIGS. 5 and 6 is a modified cover former **16*a* which includes a plurality of circumferentially spaced apart modified contactors 18*a***.

Each of the contactors **18*a*, more particularly, comprises a roller 50 which is journally connected to a roller support assembly 52. Each roller support assembly 52 is constructed and adapted to rotatingly support one of the rollers 50 so that each roller rollingly engages the sheet of material 12 and presses the sheet of material 12 against the object 14 during the forming of the decorative cover 15. Each roller support assembly 52 journally or rotatingly supports the roller 50 connected thereto and each roller support assembly 52 has one portion connected to the cover forming support assembly 28, each roller support assembly 52 supporting the roller 50 connected thereto so that an outermost end 56 of each of the rollers 50 forms the object opening 26*a* through the cover former 16*a* with the spaces between each of the circumferentially spaced rollers 50 forming recessed areas similar to the recessed areas 24 described in detail before in connection with the cover former 16 shown in FIGS. 1, 2 and 3**.

In one form, as shown in FIGS. 5 and 6, each roller support assembly 52 more particularly includes a pair of spaced apart arms 58 and 60 with one of the rollers 50 being rotatingly or journally connected to one end of each of the arms 58 and 60, the roller 50 being rotatingly supported generally between the arms 58 and 60. The end of the arm 58, opposite the end connected to the roller 50 is telescopingly connected to a tube portion 62 and a spring 64 is disposed within the tube 62, the spring 64 engaging one end of the arm 58 and one end of the tube portion 62 for biasing the arm 58 in a direction generally toward the object opening 26*a*. The end of the arm 60, opposite the end connected to the roller 50 is telescopingly connected to a tube 66 and a spring 68 is disposed within the tube portion 66, the spring 68 engaging one end of the arm 60 and one end of the tube portion 66 for biasing the arm 60 in a direction generally toward the object opening 26*a*. Thus, the springs 64 and 68 cooperate to bias the roller toward the object opening 26*a* while permitting the roller 50 to be moved in a direction generally away from the object opening 26*a* toward the cover forming support assembly 28 during the forming of the decorative cover 15. Each of the tubes 62 and 66 cooperate with the respective arms 58 and 60 to limit the movement of the arms 58 and 60 in the direction toward the object opening 26*a* or, in other words, to retain the arms 58 and 60 generally disposed within the respective tubes 62 and 66.

During the forming of the decorative cover 15 utilizing the cover former 16*a*, the sheet of material 12 is placed on the upper support surface 31 of the cover forming support assembly 28 in a manner like that described before with respect to the cover former 16 and the flower pot object 14 then is placed generally over the object opening 26*a* with the lower end 34 of the flower pot object 14 being disposed generally above the object opening 26*a* and generally above the sheet of material 12. In this position, the flower pot object 14 is moved in the downward direction 38 to a position wherein the lower end 34 of the flower pot object 14 engages the portion of the sheet of material 12 disposed generally over the object opening 26*a* and then the flower pot object 14 manually is further moved in the downward direction 38 thereby moving the sheet of material 12 and the flower pot object 14 through the object opening 26*a* in a manner like that described before with respect to the cover former 16, the sheet of material 12 and the flower pot object 14 being shown in FIG. 6 partially disposed within the object opening 26*a*. As the object 14 along with the sheet of material 12 is moved through the object opening 26*a*, each of the rollers 50 contactingly engages the sheet of material 12 and presses the sheet of material 12 into engagement with the outer peripheral surface 30 of the flower pot object 14. The flower pot object 14 along with the sheet of material 12 is moved through the object opening 26*a* to a position wherein the rim 36 of the flower pot object 14 is disposed generally adjacent the cover former 16*a* and, in this position, the rollers have operated to press the sheet of material 12 against the outer peripheral surface 30 of the flower pot object 14 generally from the lower end 34 to a position generally near the upper end 32 from below the rim 36 of the flower pot object 14 in a manner like that described before with respect to the contactors 18 and the cover former 16. Then, the flower pot object 14 along with the formed decorative cover 15 is moved in the upward direction 14 to remove the flower pot object 14 and the decorative cover 15 from the object opening 26*a* of the cover former 16*a*.

The cover former 16*a* will function to adhesively connect portions of the sheet of material 12 to the outer peripheral surface 30 of the flower pot object 14, or to form the decorative cover 15 without an adhesive connection between portions of the sheet of material 12 in the upper peripheral surface 30 of the flower pot object 14, in the manner described before with respect to the cover former 16 and the various types of sheets of material 12 with or without an adhesive.

Figure 7:
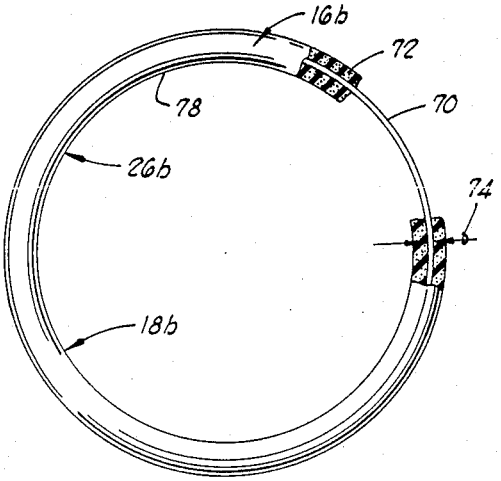
FIG. 7 is a plan view, partial sectional view of another modified cover forming apparatus.

Embodiment of FIG. 7

Shown in FIG. 7 is a cover former 16*b* which is constructed and will operate similar to the cover formers 16 and 16*a* described in detail before. The cover former 16*b* includes a circularly shaped base 70 which is constructed of a relatively rigid material such as a metal or plastic material, for example, and which, if desired in a particular application, may also be resilient in a manner like that described before with respect to the strip of material forming the cover former 16 shown in FIGS. 1, 2 and 3. A resilient material 72 is secured about the base 70 and the resilient material 72 extends circumferentially about the base 70. The resilient material 72 has a thickness 74. The resilient material may be a sponge-like material, for example, which is relatively easily compressed upon engagement. The thickness 74 of the resilient material 72 is sufficient to accommodate objects of varrying diameters such as the varrying diameter of the flower pot object 14. The resilient material has an inner peripheral outermost end 78 which extends circumferentially about the cover former 16 and forms the object opening 26*b*.

During the operation, the sheet of material 12 is placed above the object opening 26*b* and the flower pot object 14 is placed above the sheet of material. Then the flower pot object is pushed in the downward direction pushing the sheet of material 12 along with the flower pot object 14 through the object opening 26*b* in the cover former 16*b*.

As the sheet of material 12 and the flower pot object 14 are pushed through the object opening 26*a*, the inner peripheral outermost end 78 of the resilient material 72 contactingly engages the sheet of material 12 and presses the sheet of material 12 against the outer peripheral surface 30 of the flower pot object 14 to form the sheet of material 12 about the outer peripheral surface 30 of the flower pot object 14 to form a modified decorative cover (not shown).

Where the sheet of material 12 has been fully coated with adhesive, the modified decorative cover formed by the cover former 16*b* will be like the decorative cover 15, except the modified decorative cover will not include arcs of material and recessed areas like those described before with respect to the decorative cover 15 since the cover former 16*b* does not include arc-shaped portions and recess areas like the arc-shaped portions and the recess areas 24 of the cover former 16. On the other hand, a cover having such arc-shaped portions and recessed areas may be formed using this embodiment of the present invention by only partially coating the sheet of material 12 with adhesive.

The entire inner peripheral outermost end surface 76 which extends circumferentially about the cover former 16*b* forms the contactors 18*b* which, in this instance, constitute a continuous circularly shaped contacting surface.

The cover former 16*b* may be utilized to adhesively connect a portion of the sheet of material 12 to the outer peripheral surface 30 of the flower pot object 14 or the cover former 16*b* may be utilized to form the sheet of material 12 about the outer peripheral surface 30 of the flower pot object 14 in a manner like that described before with respect to the cover formers 16 and 16*a*.

Figure 8:
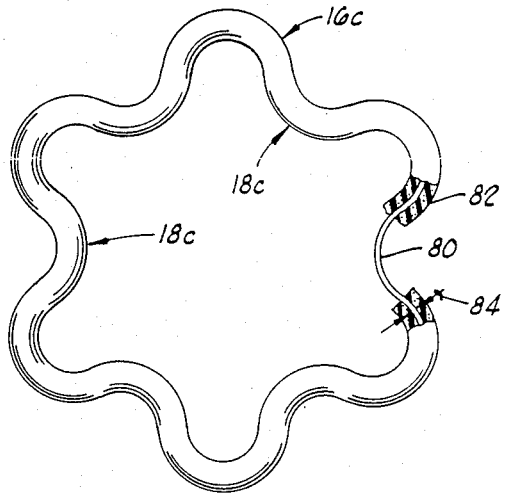
FIG. 8 is a plan view, partial sectional view of yet another modified cover forming apparatus.

Embodiment of FIG. 8

Shown in FIG. 8 is another modified cover former 16c. The modified cover former 16c includes a base 80 which is shaped exactly like the strip of material forming the cover former 16 (shown in FIGS. 1, 2 and 3). A resilient material 82 is disposed about and extends circumferentially about the base 80, the resilient material 82 having a thickness 84.

The cover former 16c will operate to form a decorative cover which substantially is the same as the decorative cover 15.

During the forming of the decorative cover 15 utilizing the cover former 16c, the portions of the resilient material 82 on the base 80 forming the contactors 18c will engage and press portions of the sheet of material 12 against the outer peripheral surface 30 of the flower pot object 14 in a manner exactly like that described before with respect to the contactors 18 on the cover former 16 (shown in FIGS. 1, 2 and 3), except as the contactor 18c portions of the resilient material 82 engage the sheet of material and the flower pot object 14, the contactor 18c portions of the resilient material 82 will compress in a manner like that described before with respect to the resilient material 72 on the base 70 (shown in FIG. 7). Thus, the base 80 does not have to be constructed of a resilient material in a manner like that described before with respect to the cover former 16.

Figure 9:
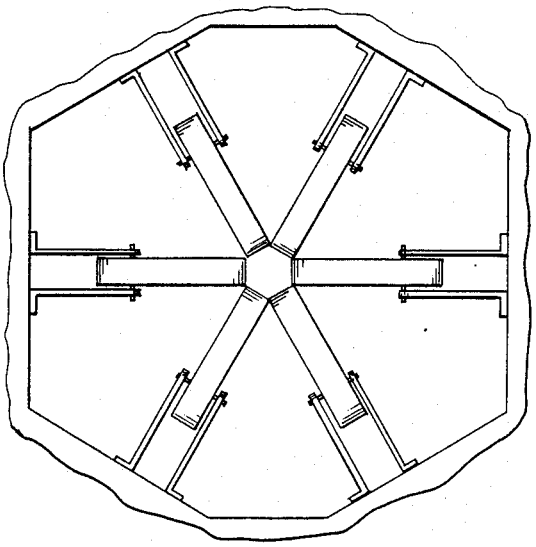
FIG. 9 is a plan view of a modified cover forming apparatus.
Figure 10:
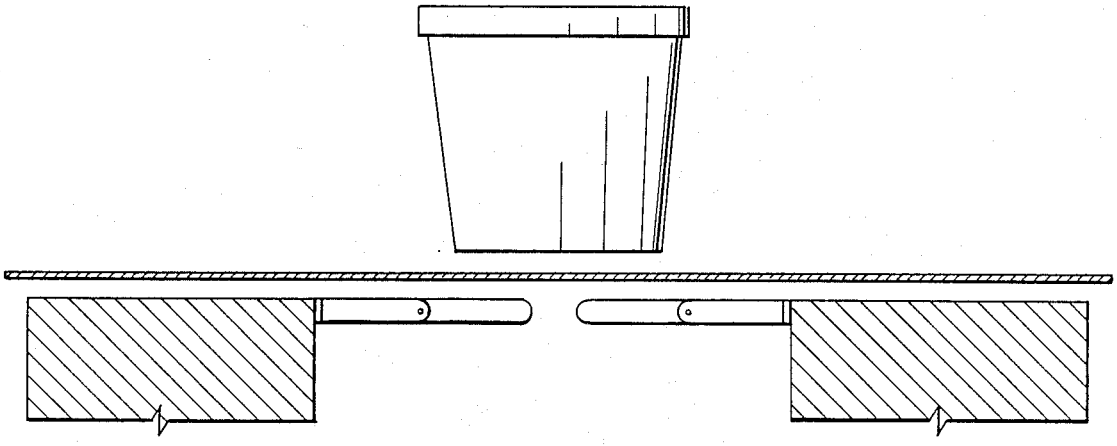
FIG. 10 is a side elevational, partially sectional view showing the modified cover forming apparatus of FIG. 9 and showing a sheet of material and a flower pot (object) in a position for forming the sheet of material about the flower pot (object).
Figure 11:
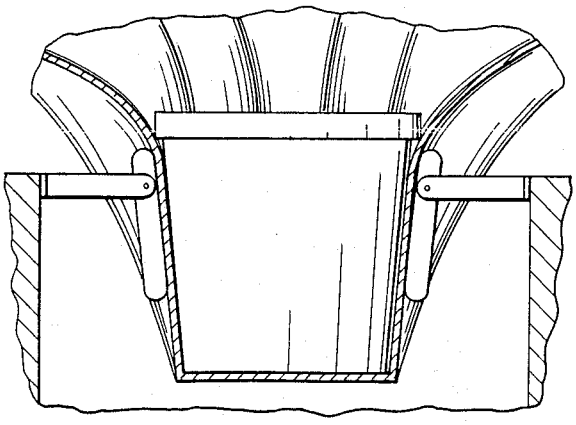
FIG. 11 is a view similar to FIG. 10, but showing the flower pot (object) and the sheet of material disposed in a portion of the cover forming apparatus during the use of the cover forming apparatus.
Figure 9:
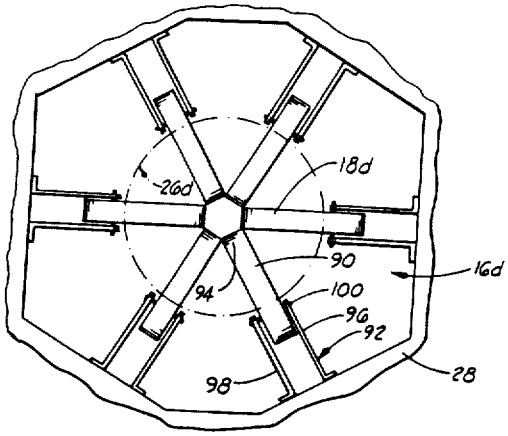
Figure 10:
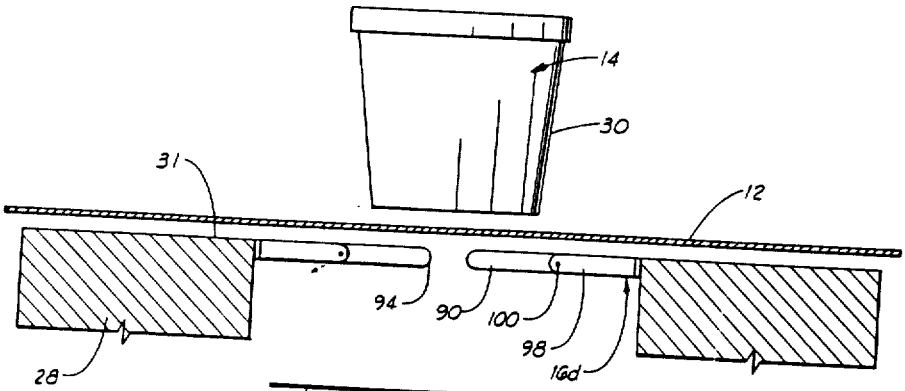
Figure 11:
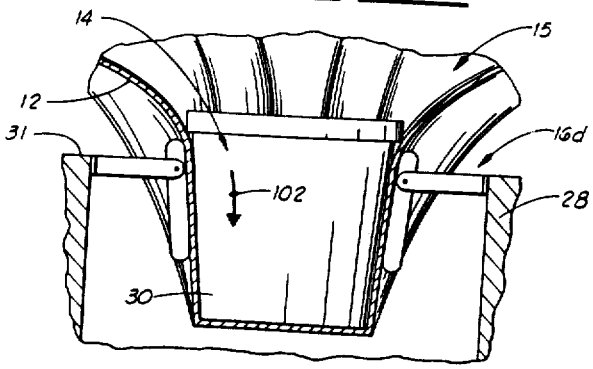

Embodiment of FIGS. 9, 10 and 11

Shown in FIGS. 9, 10 and 11 is a modified cover former 16d which includes a plurality of circumferentially spaced apart modified contactors 18d. More particularly, each of the contactors 18d comprises a bar 90 rotatably connected to a bar support assembly 92. Each bar support assembly 92 is constructed and adapted to rotatingly support one of the bars 90 so that each bar slidingly engages the sheet of material 12 and presses the sheet of material 12 against the object 14 during the forming of the decorative cover 15.

Each bar support assembly 92 rotatingly supports the bar 90 connected thereto and has one portion connected to the cover forming support assembly 28. The bar support assemblies 92 are connected to the cover forming support assembly 28 so that the outermost ends 94 of the bars 90 form the object opening 26d through the cover former 16d. Accordingly, the spaces between the bars 90 form recessed areas similar to the recessed areas 24 described above in connection with the cover former 16 shown in FIGS. 1, 2 and 3.

As shown in FIGS. 9, 10 and 11, each bar support assembly 92 comprises a pair of spaced apart arms 96 and 98 supporting a spindle 100 therebetween on which the bar 90 is rotatably mounted. Thus, when pressure in a downward direction 102 is applied to the outermost end 94 of the bar 90, the bar rotates, or pivots, in a direction such that the longitudinal axis of the bar 90 approaches perpendicularity with the longitudinal axis of the arms 96 and 98.

During the forming of the decorative cover 15 utilizing the cover former 16d, the sheet of material 12 is placed on the upper support surface 31 of the cover forming support assembly 28, as described above in connection with the cover former 16. The object 14 next is placed over the object opening 26d, also as described above. When the object 14 is moved in a downward direction 102, each of the rotating bars 90 slidably engages the sheet of material 12 and presses the sheet of material 12 against the outer peripheral surface 30 of the object 14. In other respects, the embodiment of FIGS. 9, 10 and 11 functions similarly to the other embodiments of the present invention, described in detail above.

Changes may be made in the various parts, elements and assemblies described herein without departing from the spirit and scope of the invention as defined in the following claims.

What is claimed is:

1. A cover forming appàratus for forming a sheet of material about a flower pot having an upper end, a lower end and an outer peripheral surface to produce a cover extending generally about the outer peripheral surface of the flower pot comprising:

a cover former having an object opening formed through a portion thereof adapted to receive a portion of the flower pot, the object opening being shaped generally in the shape of the outer peripheral surface of the flower pot, the cover former having portions forming resilient contactors, the contractors being resiliently engagable with portions of the sheet of material and adapted for pressing the engaged portions of the sheet of material against the outer peripheral surface of the flower pot when the flower pot with the sheet of material disposed near the flower pot are passed through the object opening, the sheet of material being formed by the cover former into the cover for the flower pot extending generally about the outer peripheral surface of the flower pot, the contactors cooperating to form the object opening, the sheet of material being disposable generally over the object opening and the flower pot being positionable generally above the portion of the sheet of material disposed generally over the object opening, the flower pot being movable to a position engaging the sheet of material and movable through the object opening, the flower pot generally engaging the sheet of material and moving the engaged portion of the sheet of material and at least a portion of the remaining portion of the sheet of material through the object opening along with the flower pot as the flower pot is moved through the object opening, the contactor portions being positioned for resiliently engaging the sheet of material and pressing the engaged portions of the sheet of material against the flower pot generally about the outer peripheral surface of the flower pot for forming the sheet of material about the outer peripheral surface of the flower pot.

2. The cover forming apparatus of claim 1 wherein the cover former is defined further as including at least two spaced apart contactors and a recessed area disposed generally between each pair of adjacent contactors, each recessed area providing a space generally spaced from the contactors in a direction generally away from the flower pot when the sheet of material and the flower pot are passed through the object opening, each recessed area being adapted to accommodate some of the sheet of material as the sheet of material and the flower pot are passed through the object opening, the portions of the sheet of material disposed in the recessed areas as the sheet of material and the flower pot are passed through the object opening for spacing such material a distance from the flower pot while the contactors resilient engage portions of the sheet of material and press such engaged portions generally against the outer peripheral surface of the flower pot, thereby forming arcs of material in the cover with each arc of material in the cover being spaced between the portions of the cover formed by the contactors, each arc of material extending a distance in an axial direction along the cover generally in the direction the sheet of material and the flower pot are passed through the object opening.

3. The cover forming apparatus of claim 2 wherein the contactors are defined further as being positioned to form a generally circularly shaped object opening, the contactors and the recessed areas each being spaced generally circumferentially about the object opening.

4. The cover forming apparatus of claim 2 wherein the cover former is defined further to include a plurality of contactors and a plurality of recessed areas.

5. The cover forming apparatus of claim 1 wherein the sheet of material is defined further as being adapted to adhesively adhere to the outer peripheral surface of the flower pot when the sheet of material is brought into contacting engagement with the flower pot by the contactors.

6. The cover forming apparatus of claim 1 wherein the sheet of material is defined further as being formable into shapes and as being settable so the sheet of material substantially retains the shape formed by the cover former as the sheet of material and the flower pot are passed through the object opening.

7. The cover forming apparatus of claim 6 wherein the sheet of material is defined further as including an adhesive material at least on the side of the sheet of material to be engaged with the outer peripheral surface of the flower pot so the portions of the sheet of material brought into contacting engagement with the outer peripheral surface of the flower pot as the sheet of material and the flower pot are passed through the object opening.

8. The cover forming apparatus of claim 1 defined further to include:

a cover forming support assembly connected to at least portions of the cover former for supporting the cover former in a generally stationary position.

9. The cover forming apparatus of claim 8 wherein the cover forming support assembly is defined further as supporting the cover former in a position wherein the object opening is disposed in a substantially horizontal plane.

10. The cover forming apparatus of claim 8 wherein the cover forming support assembly includes a support surface and an opening extending through the support surface, the cover former being supported generally within the opening in the cover forming assembly with the object opening in the cover former being substantially aligned with the opening in the cover forming support assembly.

11. The cover forming apparatus of claim 4 wherein the flower pot is defined further as having a generally circularly shaped outer peripheral surface.

12. The cover forming apparatus of claim 3 wherein the cover former is defined further as being constructed of a strip material having a plurality of generally arc-shaped portions formed therein, the outermost end portions of each arc-shaped portion being engagable with a portion of the sheet of material forming one of the contactors, the strip of material being constructed of a resilient material and the generally arc-shaped portions being resilient for resiliently engaging the sheet of material, the resilient arc-shaped portions being deformed as the sheet of material and the flower pot are passed through object opening and substantially returnable to the original non-deformed shape when the sheet of material and the flower pot are removed from the object opening.

13. The cover forming apparatus of claim 12 wherein the strip of material forming the cover former is shaped in a generally circular shape.

14. The forming apparatus of claim 1 wherein the contactors of the cover former are defined further to include:

a base; and a resilient material connected to the base and positioned for resiliently engaging the sheet of material and the flower pot as the flower pot and the sheet of material are passed through the object opening.

15. The cover forming apparatus of claim 1 wherein the contactors comprise rollers for rollingly engaging the sheet of material; and wherein the apparatus further comprises:

a roller support assembly for rotatingly supporting each roller so each roller rollingly engages the sheet of material as the sheet of material and flower pot are passed through the object opening; and wherein the cover forming apparatus is defined further to include:

a cover forming support assembly connected to each roller support assembly for supporting the roller support assemblies and the rollers connected thereto, the rollers being spaced about and forming the object opening.

16. The cover forming apparatus of claim 1 wherein the contactors comprise bars capable of slidably engaging the sheet of material as the flower pot and the sheet of material are passed through the object opening, and wherein the apparatus further comprises:

a bar support assembly connected to each bar and adapted to rotatingly support the bar; and a cover forming support assembly connected to each of the bar support assemblies and adapted for supporting the bar support assemblies and the bars connected thereto.

* * * * *

UNITED STATES PATENT AND TRADEMARK OFFICE

CERTIFICATE OF CORRECTION

PATENT NO. : 4,733,521

DATED : March 29, 1988

INVENTOR(S) : Weder et al.

It is certified that error appears in the above-identified patent and that said Letters Patent is hereby corrected as shown below:

Sheet 3 of the drawings should be replaced with sheet 3 of the revised drawings submitted July 24, 1986. A copy of revised drawing sheet 3 is attached.

Signed and Sealed this

Twelfth Day of January, 1993

*Attest:*

*Attesting Officer*

DOUGLAS B. COMER

*Acting Commissioner of Patents and Trademarks*